US005718404A

United States Patent [19]

Greer

[11] Patent Number: 5,718,404

[45] Date of Patent: Feb. 17, 1998

[54] ADAPTOR KIT FOR A TOILET PAPER ROLL HOLDER

[76] Inventor: Larry J. Greer, 182 N. Greentrails Dr., Chesterfield, Mo. 63017

[21] Appl. No.: 691,545

[22] Filed: Aug. 2, 1996

[51] Int. Cl.[6] ..... A47F 5/00

[52] U.S. Cl. ..... 248/309.2; 248/251; 242/598.2

[58] Field of Search ..... 248/201, 251, 248/309.2; 242/598.1, 598.3, 598.4, 592; 411/50, 51, 55, 60

[56] References Cited

U.S. PATENT DOCUMENTS

| | | | |
|---|---|---|---|
| 1,772,917 | 8/1930 | Sifferman | 242/598.1 |
| 2,955,504 | 10/1960 | Lovrinch et al. | 411/51 |
| 3,297,265 | 1/1967 | Turro | 242/598.1 |
| 3,848,822 | 11/1974 | Boone | 242/590 |
| 4,205,802 | 6/1980 | Economakis | 242/598.1 X |
| 4,381,083 | 4/1983 | Tsunetsugu | 242/598.1 |
| 4,416,048 | 11/1983 | Otte | 411/50 X |
| 5,456,421 | 10/1995 | Reed | 242/598.2 |
| 5,464,170 | 11/1995 | Mitchell et al. | 242/598 |

*Primary Examiner*—Ramon O. Ramirez
*Assistant Examiner*—Willie Berry, Jr.
*Attorney, Agent, or Firm*—Cohn, Powell & Hind

[57] ABSTRACT

This adaptor kit (30) is adapted for use with a conventional toilet paper roll holder (10) of the type including a rear portion (14), opposed side mounting portions (20) having sockets (22) receiving the ends of the spring-loaded core support (24). The adaptor kit (30) provides a pair of extension brackets (32) which are attachable to the side portions (22) and include an opening (40) receiving the toilet paper roll holder core support (24) to permit the conventional toilet paper roll holder (10) to receive oversize toilet paper rolls (104, 108).

10 Claims, 4 Drawing Sheets

ADAPTOR KIT FOR A TOILET PAPER ROLL HOLDER

BACKGROUND OF THE INVENTION

This invention relates generally to toilet paper roll holders and particularly to an adaptor kit for modifying a conventional holder to accept a larger diameter toilet paper roll.

Toilet paper rolls have been generally unchanged in size for at least the last century, a typical standard roll being about 4½ inches wide and 4 inches in diameter with a tubular cardboard core of about 1½ inches. Holders similarly have been unchanged in size although they have been generally of two types; namely, the standard on-wall mounting and the standard in-wall mounting.

The current trend in the production of domestic household toilet paper rolls is to make such rolls substantially larger in diameter. The width and core have not been substantially changed. Manufacturers of household toilet paper have recognized that increasing the diameter of the rolls reduces the cost of packaging materials and warehousing space and reduces the end cost to the consumer. Unfortunately, the larger rolls do not fit well into the standard mountings which were intended to suit the standard diameter rolls. Thus, the consumer is faced with the problem unanticipated by the manufacturer. The larger sized rolls, which are more economical, will not fit the standard sized holder. The problem is particularly acute with recessed type of in-wall mounting of which there are many millions already in existence. The result is that the consumer is discouraged from purchasing the more economical larger roll or does purchase it and has no practical holder for it. In the case of the double sized roll produced by one manufacturer, there is no suitable solution and the toilet paper roll must simply be balanced on a towel rack or placed on the toilet tank top, cabinet top, or on the edge of the tub or even on the floor until the toilet paper consumption has sufficiently reduced the size to permit it to fit the standard holder. The inconvenience and unsanitary nature of this solution is obvious. Another manufacture has recognized that there is a problem and has attempted to solve it by increasing the inside diameter of the roll resulting in a thinner wall section of the roll. The roll can be mounted to the standard holder. However, the increased core diameter causes the roll, at least initially, to rest on the bottom of the holder so that it cannot readily "free wheel" as intended and drags in a manner which is unacceptable to the household user.

What is needed is a simple adaptor which permits the larger sized rolls to be used on the standard sized holder.

The present adaptor solves the problems discussed above in a manner not revealed in the known prior art.

SUMMARY OF THE INVENTION

This invention relates generally to toilet paper roll holders and, in particular, provides an adaptor kit for converting standard toilet paper roll holders intended for standard size toilet paper rolls to accept larger toilet paper rolls.

The kit provides a means of overcoming the objections to using larger than standard toilet paper rolls without having to replace the standard toilet paper roll holders which are already installed in the majority of households in the United States and elsewhere.

The kit encourages manufacturers to promote and consumers to take advantage of the economy and conservation advantages inherent in larger size toilet paper rolls.

This adaptor kit is for a toilet paper roll holder of the type including rear portions, opposed side mounting portions and a toilet paper roll support core extending between said side portions, said mounting portions having axially aligned support core receiving means, the kit enabling conversion of the holder to receive larger diameter toilet paper rolls and the kit comprising opposed extension bracket means each bracket means having attachment means for attaching the bracket means to the toilet paper roll holder, and mounting means for mounting the support core to an associated bracket means in spaced relation outwardly from the toilet paper roll holder support core receiving means so that the larger toilet paper roll is clear of the toilet roll holder.

It is an aspect of this invention to provide an adaptor kit for a toilet paper roll holder of the type including a toilet paper roll accepting recess defined by a rear wall, opposed side arms, and a toilet paper roll support core extending between said side arms, said side arms having axially aligned support core receiving recesses, the kit enabling conversion of the holder to receive larger diameter toilet paper rolls and the kit comprising a pair of opposed extension brackets, each bracket having attachment means for attaching-the bracket to an associated toilet paper roll holder support core receiving socket, and mounting means for mounting the support core to an associated bracket in spaced relation outwardly from the toilet paper roll holder support core receiving socket so that the larger toilet paper roll is clear of the rear wall.

It is another aspect of this invention to provide that each attachment means includes an expanding fastener means extending into and cooperating with said toilet paper roll holder support core receiving socket.

It is yet another aspect of this invention to provide that each attachment means includes an opening in said bracket; an expandable boss disposed on one side of the bracket adjacent the toilet paper roll holder support core receiving socket, a tapered nut received within said boss and a threaded member extending through said opening and receiving said tapered nut in threaded relation for moving said nut into said boss to expand said boss into engagement with the toilet paper roll holder socket and secure said bracket firmly to said socket. It is another aspect that the boss is of a softer material than the taper nut to facilitate expansion of the boss.

It is still another aspect of this invention to provide that said expandable boss includes a tapered socket portion receiving said tapered nut.

It is an aspect of this invention to provide that said expandable boss includes a plurality of circumferentially separated segmental portions defining a tapered socket receiving said tapered nut, said segmental portions moving radially outward into engagement with said toilet paper roll holder support core receiving socket as said nut moves into said socket.

It is yet another aspect of this invention to provide that said bracket includes a base and said expandable boss is integrally formed with said base.

It is still another aspect of this invention to provide that said bracket includes a base and said expandable boss is a separate part.

It is another aspect of this invention to provide that each mounting means includes an opening in said bracket receiving said core support therein.

This toilet paper roll holder adaptor kit is inexpensive, simple to manufacturer, easy to install and performs its intended function with particular efficiency.

DESCRIPTION OF THE PREFERRED EMBODIMENT

Figure 1:
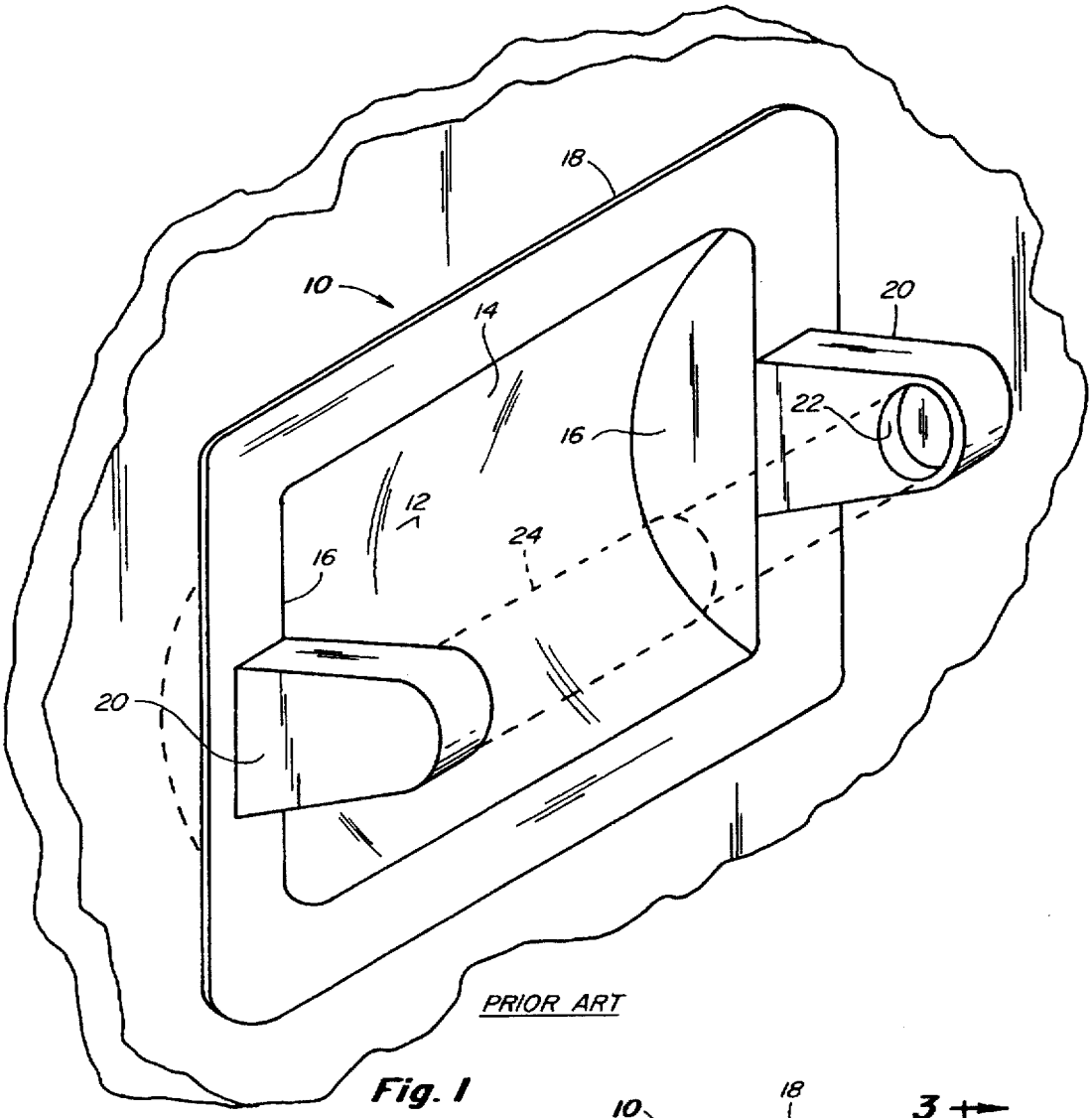
FIG. 1 is a perspective view of a standard recessed toilet paper roll holder.

Referring now by reference numerals to the drawings and first to FIG. 1, it will be understood that a standard or conventional in-wall toilet paper roll holder is generally indicated by numeral 10. As shown, the holder 10 includes a recessed pocket 12, having a curved rear wall 14 and side walls 16, surrounded by a fascia plate frame 18. The holder 10 also includes side arms 20 having sockets or recesses 22 which receive the ends of a conventional spring-loaded core support 24, said support being received and held in the sockets 22.

Figure 3:
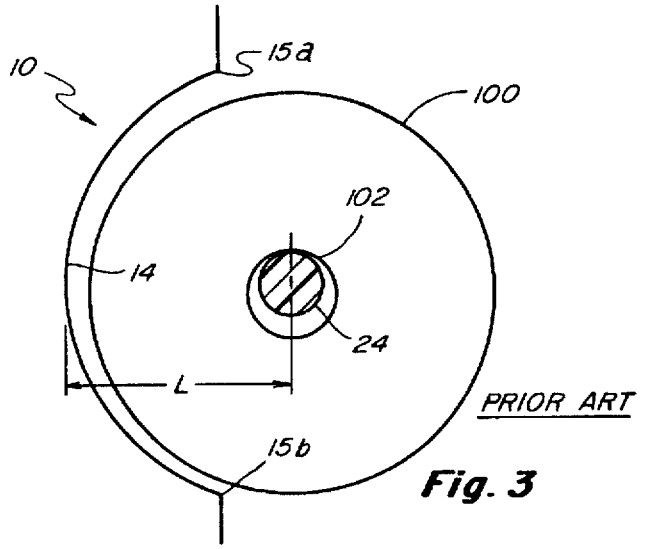
FIG. 3 is a diagrammatic illustration taken on Line 3—3 of FIG. 2, showing a standard recessed toilet paper roll holder used with a standard toilet paper roll.
Figure 4:
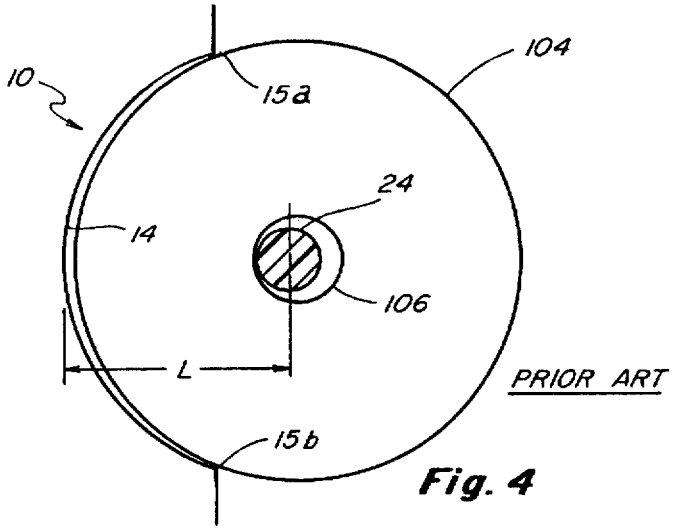
FIG. 4 is a diagrammatic illustration similar to FIG. 3, but showing the standard recessed toilet paper roll holder used with an oversized toilet paper roll.
Figure 5:
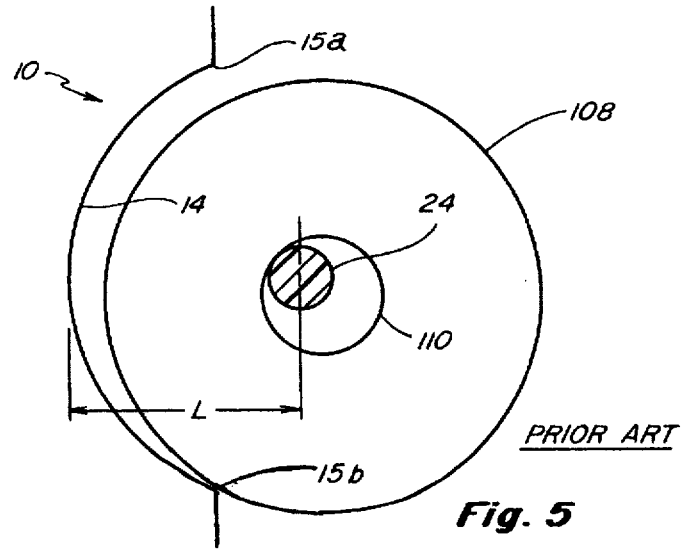
FIG. 5 is another diagrammatic illustration similar to FIG. 3 but showing the standard recessed toilet paper roll holder used with an oversized toilet paper roll having an enlarged core.

FIG. 3 illustrates diagrammatically the relationship of a standard or conventional toilet paper roll 100 to the toilet paper roll holder 10. As shown in FIG. 3 the core support 24 having an axis at a distance L from the curved rear wall 14 extends through the roll tube 102 to hold the roll 100 clear of the curved rear wall 14 and the upper and lower corners indicated by 15*a* and 15*b* without interference. The roll 100 is thus able to free wheel easily on the core support 24 without interference. FIG. 4 illustrates diagrammatically the relationship of an oversized toilet paper roll 104 to the geometry of the same conventional toilet paper roll holder 10. As shown, interference between the oversized roll 104 and the corners 15*a* and 15*b* prevent the core support 24 from being received in the roll core tube 106 until the roll 104 is partially depleted. FIG. 5 illustrates diagrammatically the relationship of another oversized toilet paper roll 108 to the geometry of the same toilet paper roll holder 10, said toilet paper roll 108 having a larger core tube 110. As shown, the larger core tube 110 can receive the core support 24 but is susceptible to interference with the lower corner 15*b* which results in drag, again until the toilet paper roll 108 is partially depleted. Neither of these toilet paper rolls 104 or 108 is satisfactorily held by the conventional toilet paper roll holder 10, to the considerable inconvenience of the user.

The adaptor kit 30 provides a means of extending the center of the core support 24 outwardly beyond the distance L to permit the standard toilet paper roll holder 10 to be easily converted for use with oversized toilet paper rolls 104, 108 substantially without drag resulting from engagement with the toilet roll holder as will now be described by reference to FIGS. 5–11.

Figure 6:
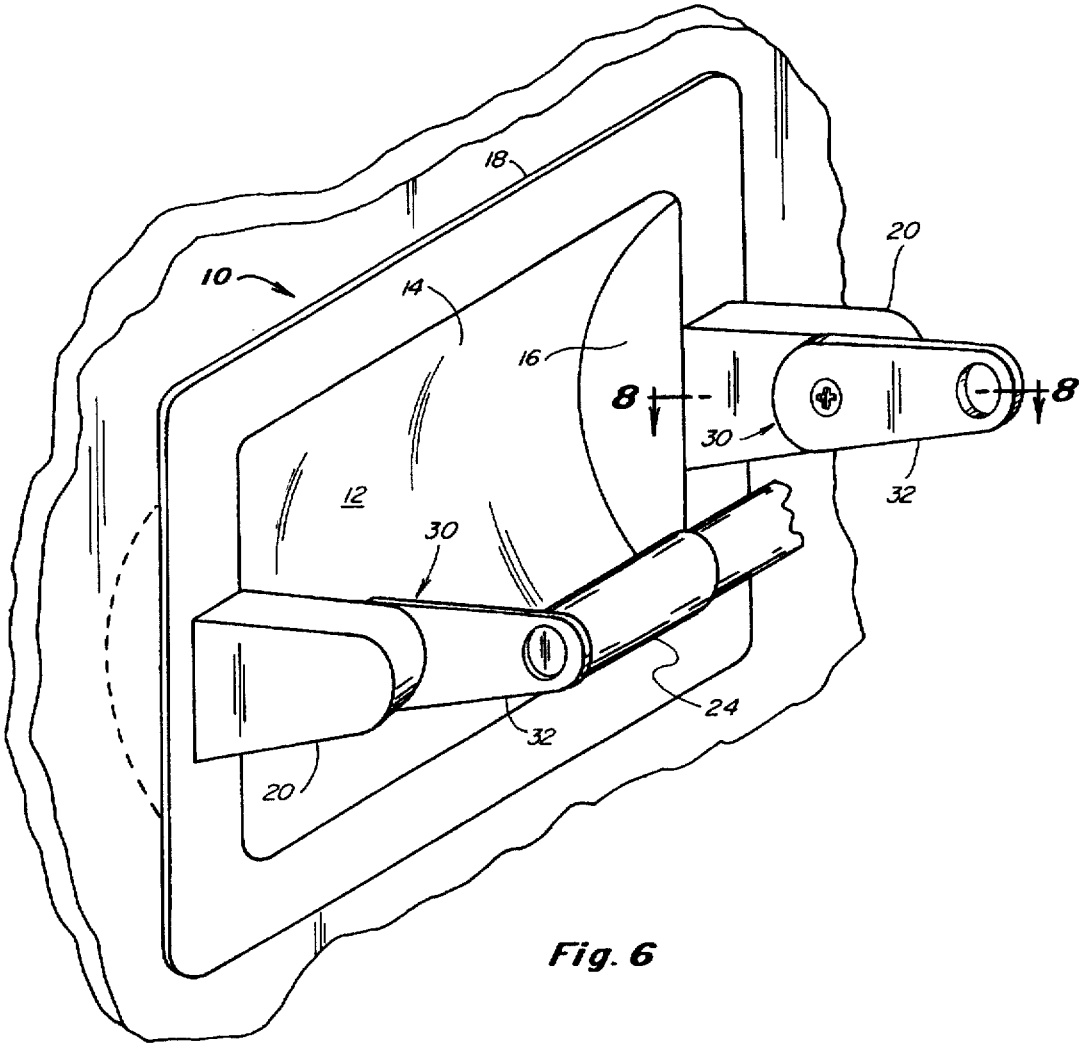
FIG. 6 is a similar view to FIG. 1 showing the standard recessed toilet paper roll holder with adaptor kit installed.
Figure 7:
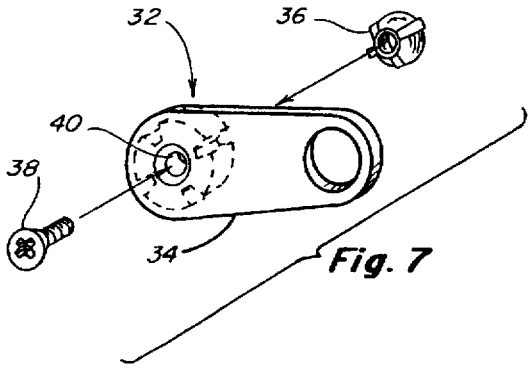
FIG. 7 is an exploded perspective view of the adaptor bracket parts.
Figure 10:
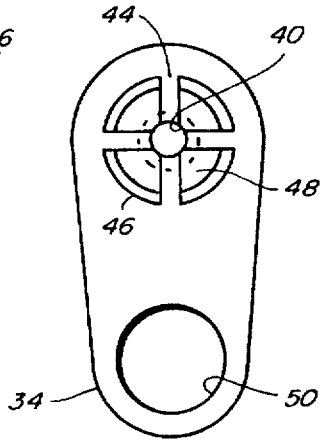
FIG. 10 is a front elevational view of the bracket base plate taken on Line 10—10 of FIG. 9.
Figure 9:
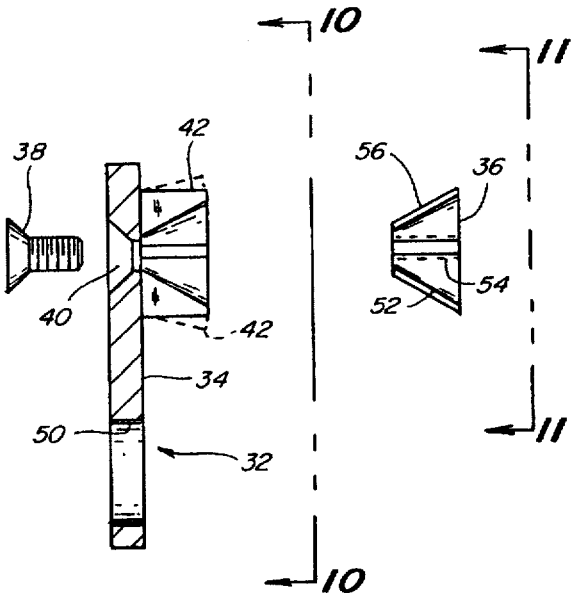
FIG. 9 is an exploded cross-sectional view of the adaptor bracket parts prior to installation.

FIG. 6 illustrates the toilet paper roll holder 10 with the adaptor kit installed, and the component parts of the kit 30 are illustrated in FIG. 7. As shown in FIGS. 6 and 7, the adaptor kit comprises a pair an extension brackets 32 each including a base 34, a taper nut 36 and a machine bolt 38. As best shown in FIGS. 8–11 the base 34 includes a relatively small countersunk opening 40, and an integrally formed, generally cylindrical expandable boss 42 formed on one side. As best shown in FIG. 10, the boss 42 is separated by slots 44 into four quadrants 46 defining a generally conical recess 48 communicating with the opening 40. A relatively large core holder receiving opening 50 is spaced outwardly from the small countersunk opening 40. The taper nut 36 includes a frusto-conical body 52 having a threaded passage 54, adapted to receive the machine bolt 38, and longitudinal ribs 56 adapted to be received within the boss slots 44 in interfitting sliding relation. The taper nut 36 has the same taper as the conical recess 48 and substantially the same length but a larger maximum diameter.

Figure 8:
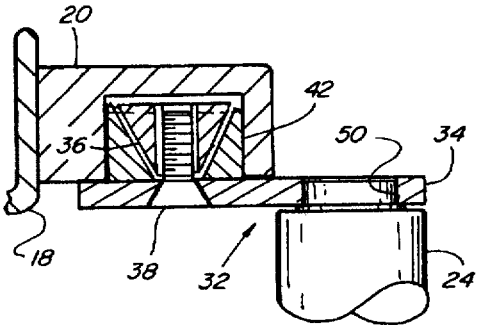
FIG. 8 is a cross-sectional view of the adaptor bracket parts installation taken on Line 8—8 of FIG. 6.
Figure 11:
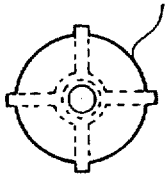
FIG. 11 is a front elevational view of the taper nut taken on Line 11—11 of FIG. 9.

The installed extension bracket is best shown by reference to FIG. 8. It will be understood that the machine bolt 38 passes through the opening 40 and is received within the threaded opening of the taper nut 36 in loosely connected pre-assembly relation. At this stage, the pre-assembled boss 42 and taper nut 36 can be pushed into the socket 22, and the base 34 pressed against the inside face of the side arm 20. By tightening the machine bolt 38, the taper nut is drawn into the tapered recess 48 and tends to expand the boss quadrants 46 into the position shown in phantom outline in FIG. 9 and into gripping engagement with the cylindrical wall of the toilet paper roll holder side arm socket 22 as shown in FIG. 8 so that the bracket is held firmly in place within said socket. In the preferred embodiment, the taper nut 36 is of a harder material than the base boss 42. For example, the base and boss may be of an elastomeric material such as polycarbonate and the taper nut of a material such as steel or harder plastic such as Teflon. It will be understood that this combination facilitates expansion of the boss 42. Both brackets 32 are installed as described, in mirror image of each other, taking care to maintain alignment of the core holder receiving openings 50. With both brackets 32 installed, the core holder 24 can be installed into the openings 50.

Figure 14:
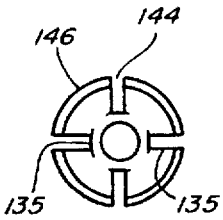
FIG. 14 is a front elevational view of the modified bracket expander taken on Line 14—14 of FIG. 12.
Figure 13:
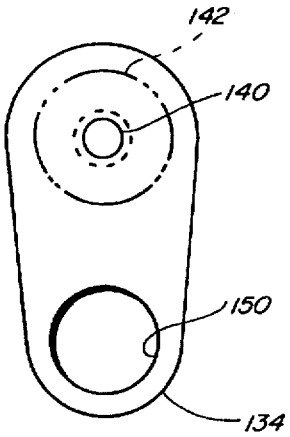
FIG. 13 is a front elevational view of the modified adaptor bracket base taken on Line 13—13 of FIG. 12.
Figure 12:
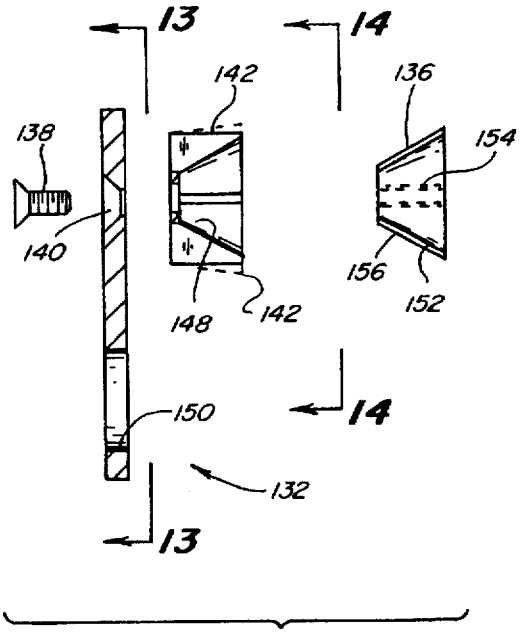
FIG. 12 is an exploded cross-sectional view of the parts of a modified adaptor bracket.

A modified bracket 132 is shown in FIGS. 12–14 which is similar to the bracket 32 shown in FIGS. 8–11 except that the extension bracket base 134 includes a separately formed boss 142 having web portions 135 between the quadrants 146. As with the first embodiment, the taper nut 136 is preferably formed from a harder material than the boss 142. The installation and operation of the bracket 32 and the modified bracket 132 are virtually identical. Similar parts in FIGS. 12–14 are given the same reference numeral as in FIGS. 9–11 with the addition of a prefix numeral 1.

Figure 15:
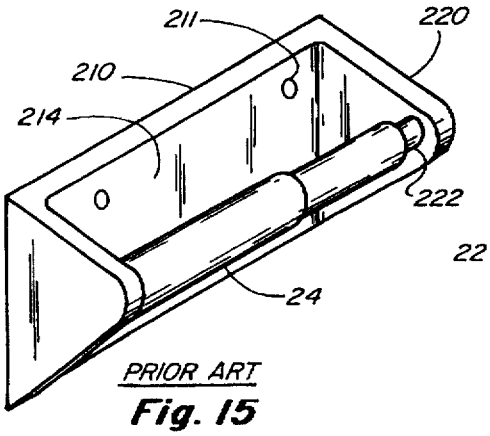
FIG. 15 is a perspective view of a conventional on-wall holder.
Figure 2:
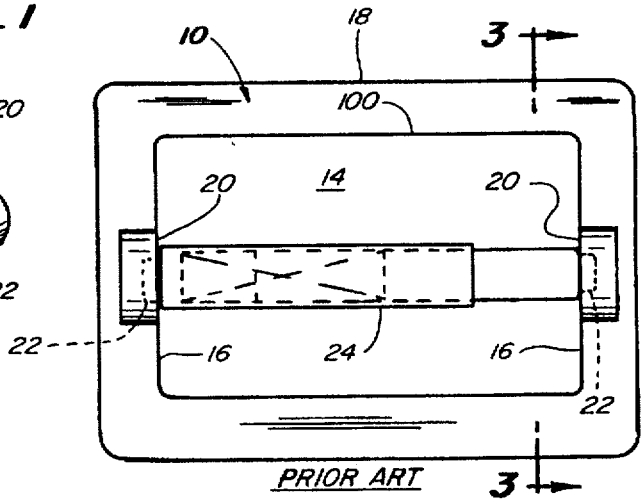
FIG. 2 is a front elevational view of a standard toilet paper roll holder.

The kit 30 has been shown used in conjunction with a conventional in-wall holder. It will be understood, however, that it could be used in conjunction with a conventional on-wall holder of the type shown in FIG. 15 by numeral 210. The holder 210 includes a rear wall 214 attached to the wall by means of screws 211 and side walls 220 having socket 220. The installation of the kit 30 is exactly the same as with the in-wall holder 10 and needs no further explanation.

In view of the above, it will be seen that various aspects and features of the invention are achieved and other advantageous results attained. While preferred embodiments of the invention have been shown and described, it will be obvious to those skilled in the art that changes and modifications may be made therein without departing from the invention in its broader aspects.

I claim as my invention:

1. An adaptor kit for a toilet paper roll holder of the type including a toilet paper roll accepting recess defined by a rear wall, opposed side arms, and a toilet paper roll support core extending between said side arms, said side arms having axially aligned support core receiving sockets the kit enabling conversion of the holder to receive larger diameter toilet paper rolls and the kit comprising:

(a) a pair of opposed independent extension brackets, each bracket including:

(i) attachment means adapted to securely attach the bracket to an associated toilet paper roll holder support core receiving socket substantially precluding movement of the bracket, and (ii) mounting means adapted to mount the same support core to an associated bracket in spaced relation outwardly from the toilet paper roll holder support core receiving socket so that the larger toilet paper roll is substantially clear of the toilet roll holder.

2. An adaptor kit as defined in claim 1, in which:

(b) each attachment means includes a radially expandable fastener means adapted to extend into and cooperate into and with said toilet paper roll holder support core receiving socket.

3. An adaptor kit for a toilet paper roll holder of the type including a toilet paper roll accepting recess defined by a rear wall, opposed side arms, and a toilet paper roll support core extending between said side arms, said side arms having axially aligned support core receiving sockets, the kit enabling conversion of the holder to receive larger diameter toilet paper rolls and the kit comprising:

a pair of opposed independent extension brackets, each bracket including:

(i) attachment means adapted to securely attach the bracket to an associated toilet paper roll holder support core receiving socket, and (ii) mounting means adapted to mount the same support core to an associated bracket in spaced relation outwardly from the toilet paper roll holder support core receiving socket so that the larger toilet paper roll is substantially clear of the toilet roll holder, (b) each attachment means including an opening in said bracket; an expandable boss disposed on one side of the bracket adapted to be adjacent the toilet paper roll holder support core receiving socket, a tapered nut received within said boss and a threaded member extending through said opening and receiving said tapered nut in threaded relation and adapted to move said nut into said boss to expand said boss radially into engagement with the toilet paper roll holder socket and secure said bracket firmly to said socket.

4. An adaptor kit as defined in claim 3, in which:

(c) said expandable boss includes a tapered socket portion receiving said tapered nut.

5. An adaptor kit as defined in claim 3, in which:

(c) said expandable boss includes a plurality of circumferentially separated segmental portions defining a tapered socket receiving said tapered nut, said segmental portions moving radially outward into engagement with said toilet paper roll holder support core receiving socket as said nut moves into said socket.

6. An adaptor kit as defined in claim 3, in which:

(c) said bracket includes a base and said expandable boss is integrally formed with said base.

7. An adaptor kit as defined in claim 3, in which:

(c) said bracket includes a base and said expandable boss is a separate part.

8. An adaptor as defined in claim 3, in which:

(c) the material of the boss is softer than the material of the nut to facilitate expansion of the boss.

9. An adaptor kit for a toilet paper roll holder of the type including a toilet paper roll accepting recess defined by a rear wall, opposed side arms, and a toilet paper roll support core extending between said side arms, said side arms having axially aligned support core receiving sockets, the kit enabling conversion of the holder to receive larger diameter toilet paper rolls and the kit comprising:

(a) a pair of opposed independent extension brackets, each bracket including:

(i) attachment means adapted to securely attach the bracket to an associated toilet paper roll holder support core receiving socket substantially precluding movement of the bracket, and (ii) mounting means adapted to mount the same support core to an associated bracket in spaced relation outwardly from the toilet paper roll holder support core receiving socket so that the larger toilet paper roll is substantially clear of the toilet roll holder, (b) each mounting means including an outwardly spaced opening in said bracket adapted to receive said support core therein.

10. An adaptor kit for a toilet paper roll holder of the type including a toilet paper roll accepting recess defined by a rear wall, opposed side arms, and a toilet paper roll support core extending between said side arms, said side arms having axially aligned support core receiving recesses, the kit enabling conversion of the holder to receive larger diameter toilet paper rolls and the kit comprising:

(a) a pair of independent extension brackets, each bracket having:

(i) attachment means adapted to attach the bracket to an associated toilet paper roll support core receiving socket, each attachment means including an opening in said bracket and an expandable boss provided on one side of said bracket, said boss including a plurality of circumferentially separated segmental portions defining a tapered socket, a tapered nut receivable within said tapered socket and a threaded member extending through said opening and receiving said tapered nut in threaded relation for moving said nut into said boss to and adapted to move said segmental portions radially outward into engagement with said toilet paper roll support core receiving socket and secure said bracket firmly to said socket, and (ii) each bracket including a mounting opening disposed in spaced relation from said boss and adapted to receive said same support core so that the larger toilet paper roll is substantially clear of said toilet roll holder.

* * * * *